United States Patent [19]

Avedian

[11] 4,139,188

[45] Feb. 13, 1979

[54] MACHINE VISE

[76] Inventor: Aram Avedian, 12047 Clover Ave., Los Angeles, Calif. 90066

[21] Appl. No.: 883,385

[22] Filed: Mar. 6, 1978

[51] Int. Cl.[2] ..... B25B 1/08

[52] U.S. Cl. ..... 269/196; 269/229; 269/283

[58] Field of Search ..... 269/171, 196, 199, 200, 269/217, 229, 231, 232, 235, 279, 283

[56] References Cited

U.S. PATENT DOCUMENTS

| | | | |
|---|---|---|---|
| 1,994,217 | 3/1935 | Guillaix | 269/279 |
| 2,631,483 | 3/1953 | Swain | 269/199 |
| 3,768,797 | 10/1973 | Kartasuk et al. | 269/283 |

*Primary Examiner*—Robert C. Watson

*Attorney, Agent, or Firm*—Fulwider, Patton, Rieber, Lee & Utecht

[57] ABSTRACT

A machine vise is provided comprising a body, a fixed jaw at one end which is adaptable for accommodating irregularly shaped workpieces, a movable jaw mounted on the body and slidable toward and away from the fixed jaw, a cam for urging the movable jaw into gripping relation with a workpiece disposed between the jaws and a pair of wedge elements for locking the cam in a fixed longitudinal position with respect to the body.

13 Claims, 10 Drawing Figures

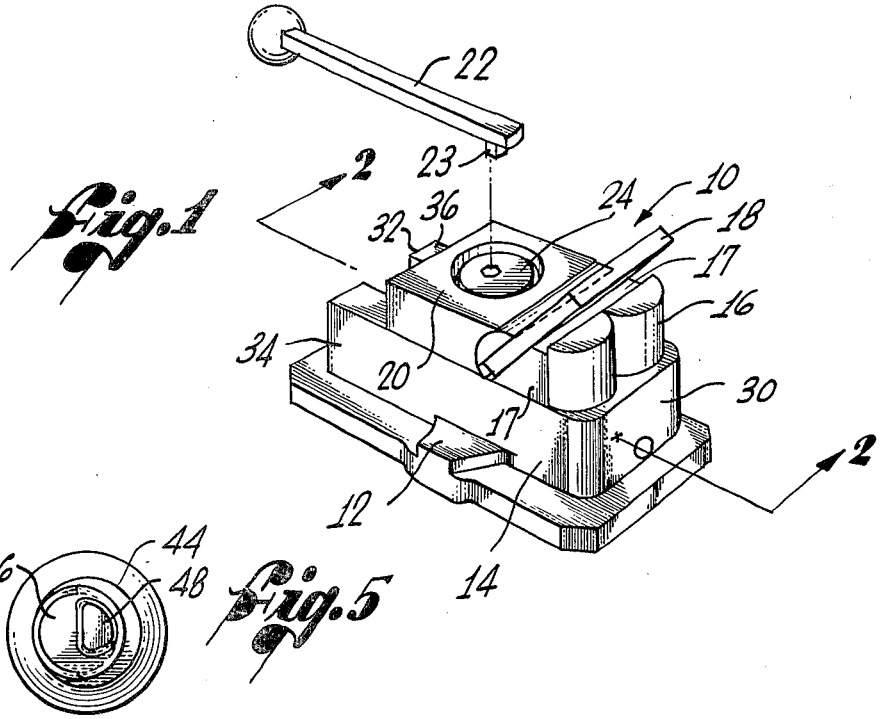
Fig. 1
Fig. 5
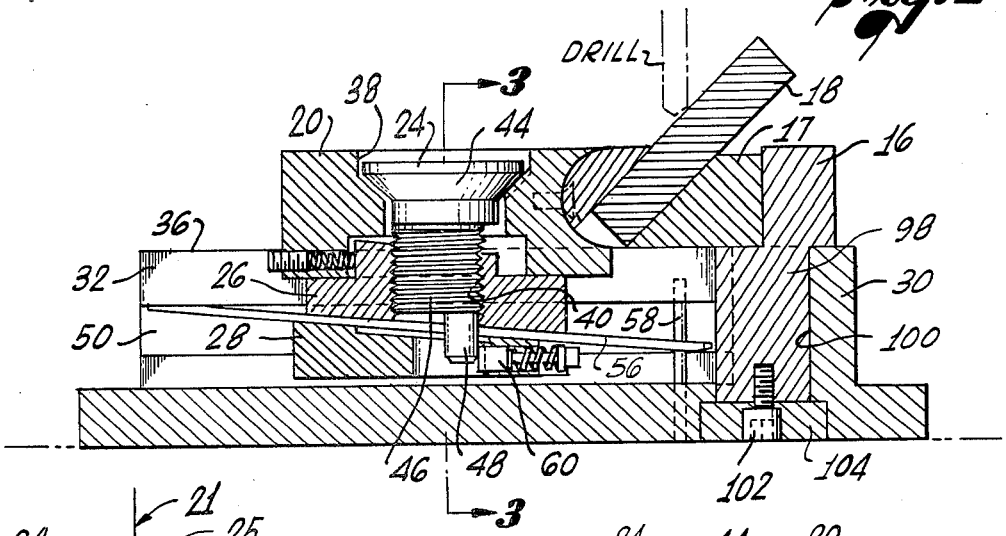
Fig. 2
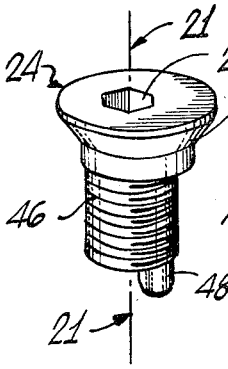
Fig. 4
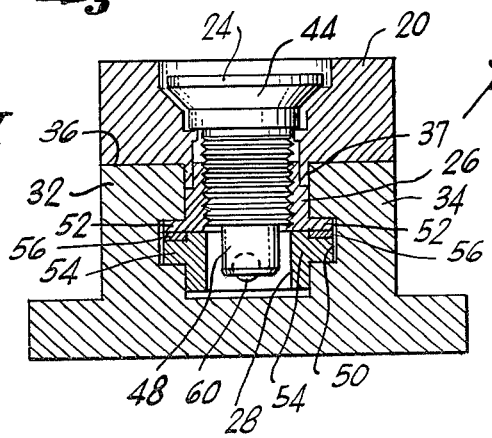
Fig. 3

MACHINE VISE

BACKGROUND OF THE INVENTION

This invention relates to vises for releasably holding an object between a pair of jaws, and more particularly, to a precision machine vise for mounting on the table of a machine, and holding an object upon which work is to be performed by the machine.

It is highly desirable for a machine vise to be easily adaptable for holding objects or workpieces of irregular shape and varying sizes, and it is particularly desirable for such a vise to be arranged for releasing one workpiece and setting up another workpiece of a substantially different size quickly and easily. Heretofore, a workpiece has been set up on a machine by providing a vise having a fixed jaw and a movable jaw each having a flat vertical surface facing the other, and the movable jaw being moved toward and away from the fixed jaw by a longitudinal threaded shaft. In this type of vise, the shaft is provided with threads having a relatively short pitch so that a high mechanical advantage is available for clamping the workpiece tightly within the vise. This arrangement is characterized by the disadvantage that in order to move the movable jaw through any substantial distance either toward or away from the fixed jaw, the threaded shaft must be rotated many times in the appropriate direction. Further, in order to properly hold an irregularly shaped workpiece, several, often complex, adapting pieces must be carefully arranged between the jaws, and occasionally must be bolted to the jaws.

Accordingly, there has existed a need for a convenient and effective machine vise having a jaw which can be moved quickly from one position to another for holding workpieces of various sizes, and having jaws which are easily adaptable for holding irregularly shaped workpieces. As will become apparent from the following, the present invention satisfies these needs.

SUMMARY OF THE INVENTION

The present invention provides a machine vise having a movable jaw which can be rapidly adjusted for holding workpieces of various sizes, and having both a movable jaw and a fixed jaw which can be easily adapted for holding irregularly shaped workpieces. Moreover, the construction of the vise of the present invention is trouble free and reliable in use, and the movable jaw is movable toward and away from the fixed jaw without requiring a longitudinal threaded shaft.

More specifically, the machine vise of the present invention includes a body with a fixed jaw mounted at one end, and a movable jaw mounted on the body and slidable toward and away from the fixed jaw. A cam member is provided which operatively connects the movable jaw with a pair of wedge elements disposed in the body, and upon rotation of the cam member in a first direction, the wedge elements are moved into locking relation with the body and the movable jaw is moved a small increment of distance toward the fixed jaw to firmly grip a workpiece. To release the workpiece, the cam member is rotated in the opposite direction, thereby urging the movable jaw away from the fixed jaw and moving the wedge elements out of locking relation with the body. When the wedge elements are out of locking relation with the body, the movable jaw can be moved by hand quickly and easily to any desired position on the body.

The wedge elements are disposed one over the other beneath the movable jaw, and each has a pair of wedge shaped wings which project laterally into a pair of longitudinal channels formed in the body. The cam member is threadably received in the upper wedge, and has an eccentric lug projecting downwardly into an opening in the lower wedge for moving the wedges into and out of locking relation upon rotation of the cam member. In order to prevent the wedges from slipping when the movable jaw is tightened upon a workpiece, a longitudinal ramp may be provided between the wings in the channels. Preferably, the ramp thickness increases at a slight angle toward the fixed jaw end of the vise, and the lower surfaces of the channels are inclined downwardly at the same angle toward the fixed jaw end of the vise. In this way, an additional component of force is provided for resisting slippage of the wedges when the movable jaw is tightened against a workpiece. Alternatively, a constant thickness ramp may be used for the purpose of preventing the slippage of the wedges, and in that instance, the lower surfaces of the channels are parallel to the upper surfaces of the channels.

For holding a workpiece between the jaws, a cam surface on the cam member bears against a following surface on the movable jaw and moves the movable jaw an increment of distance toward the fixed jaw upon rotation of the cam member. In order to facilitate holding workpieces of various irregular shapes, a set of bearing elements is provided which may be interchangeably mounted on the side of the movable jaw facing the fixed jaw, and the fixed jaw includes a pair of laterally positioned upright posts which are mounted in the body for rotation about a vertical axis and which selectively present a flat or curved surface toward the movable jaw.

Other features and advantages of the present invention will become apparent from the following detailed description taken in conjunction with the accompanying drawings, which illustrate, by way of example, the principals of the invention.

BRIEF DESCRIPTION OF THE DRAWINGS

FIG. 1 is a perspective view of the machine vise of the present invention and illustrated holding a conventional workpiece and having an operating handle in exploded position therefrom;

FIG. 2 is an enlarged partly sectional view of the machine vise of the present invention and taken substantially along line 2—2 of FIG. 1;

FIG. 3 is a partly sectional view of the machine vise of the present invention taken substantially along line 3—3 of FIG. 2;

FIG. 4 is a perspective view of the cam member employed in the machine vise of the present invention;

FIG. 5 is a bottom view of the cam member of FIG. 4;

DETAILED DESCRIPTION

Figure 6:
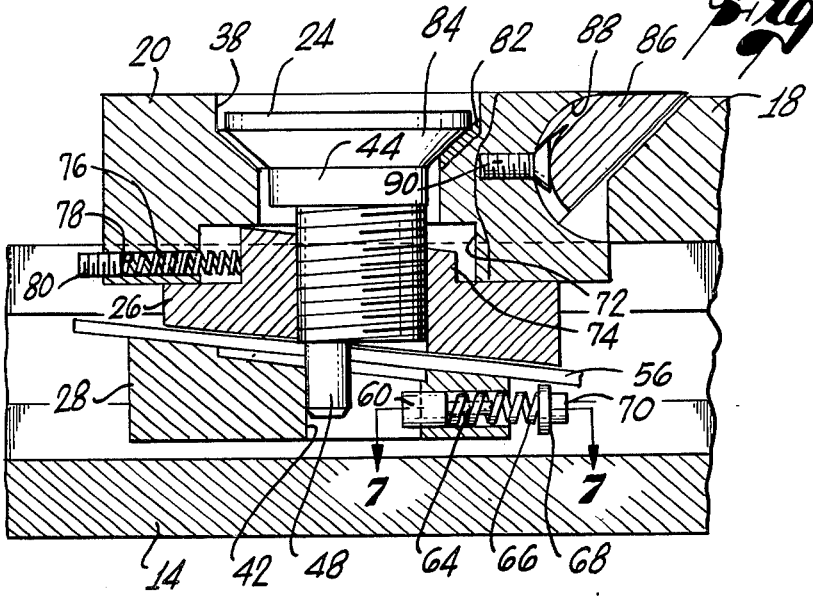
FIG. 6 is a further enlarged fragmentary partly sectional view of the machine vise of the present invention taken substantially along line 2—2 of FIG. 1 and showing the vise in its released position.

As shown in the exemplary drawings, the present invention is embodied in a machine vise 10 of the type having a flange 12 for mounting the vise on the table of a machine (not shown) such as a drill press, milling machine or the like. The vise includes a longitudinally extending body portion 14 having at least one upstanding fixed jaw 16 at one end thereof.

For rigidly holding a workpiece 18 on the machine table, a movable jaw 20 is slidably mounted on the body portion 14 and is movable toward and away from the fixed jaw 16, and a changeable angle block 17 can be employed to adapt the fixed jaw 16 to the shape of the workpiece 18. A detachable operating handle 22 is provided for moving the movable jaw 20 toward and away from the fixed jaw 16 for gripping and releasing the workpiece 18.

In accordance with the present invention, a cam 24 is provided for moving the movable jaw 20 into and out of gripping relation with the workpiece 18, and for operating a locking means which locks the cam 24 in a fixed position with respect to the body 14 at any desired location along the body. Further, the vise of this invention may be adjusted rapidly for holding workpieces of various sizes and both the movable jaw and the fixed jaw can be easily adapted for holding irregularly shaped workpieces.

In order to firmly grip the workpiece 18, the movable jaw 20 is positioned adjacent the workpiece and cam 24 is rotated to urge the movable jaw a small increment of distance toward the workpiece 18. For this cam action to effectively hold the workpiece, the cam must be locked in a fixed longitudinal position with respect to the body 14.

The means for locking the cam 24 in a fixed position with respect to the body 14 at any desired location along the body includes an upper wedge 26 and a lower wedge 28 which are moved longitudinally toward and away from each other by rotation of the cam 24. Toward this end, the body 14 is generally U-shaped having a laterally oriented upstanding front wall 30 at one end, and two longitudinally extending laterally spaced, parallel upstanding walls 32 and 34 forming a top surface 36 upon which the movable jaw 20 is slidably mounted spanning across both longitudinally extending walls. For guiding the movable jaw 20 along the surface 36, the movable jaw 20 has a pair of downwardly projecting flanges 37 which slidably engage the inwardly facing surface of both of the walls 32 and 34 (FIG. 3). The upper wedge 26 and the lower wedge 28 are disposed below the movable jaw 20 in the space between the longitudinally extending walls 32 and 34 so that a central aperture 38 in the movable jaw 20 is aligned with an internally threaded aperture 40 in the upper wedge 26 and a lug receiving aperture 42 in the lower wedge 28. As can best be seen in FIGS. 2 and 3, the cam 24 is vertically disposed within all three of the above mentioned aligned apertures, having an eccentric head portion 44 disposed in the central aperture 38 of the movable jaw 20, a central portion 46 threadably received in the internally threaded aperture 40 of the upper wedge 26, and an eccentric lug 48 is pendantly disposed in the lug receiving aperture 42 of the lower wedge 28.

The cam 24 is constrained for rotation within the aperture 40 of the upper wedge 26, and as can best be seen in FIGS. 4 and 5, the cam 24 rotates about a vertical axis indicated at reference numeral 21 passing through the center of the central portion 46. In order to facilitate the manual rotation of the cam 24, a recess 25 is provided in the top of the cam along the axis 21 for receiving a cooperating projection 23 on the operating handle 22. The head portion 44 and the lug 48 are offset from the axis 21 in the same radial direction thereby causing them to rotate eccentrically in the apertures 38 and 42 respectively as further described below.

In the inwardly facing surface of both of the walls 32 and 34 a longitudinally extending, rectangularly shaped channel 50 is formed which opens into the space between the walls 32 and 34. The upper wedge 26 has a pair of wedge shaped wings 52 which project laterally into the upper region of the longitudinal channels 50, and the lower wedge 28 has a pair of wedge shaped wings 54 which project laterally into the lower region of the channels 50. A ramp element 56 is disposed between the wings 52 and 54 in each of the channels 50, and each of the ramp elements 56 is slidably retained at its forward end on a pin 58 so that the ramp element 56 can move up and down within the channel 50 as the upper and lower wedges 26 and 28 are moved longitudinally.

Figure 7:
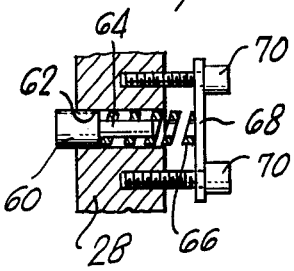
FIG. 7 is a partly sectional fragmentary view taken substantially along line 7—7 of FIG. 6.

For the purpose of locking the upper and lower wedges 26 and 28 in a fixed position with respect to the body 14, a follower 60 is provided on the front wall of the lug receiving aperture 42, and as the cam 24 is rotated about its vertical axis, the lug 48 bears against the follower 60 and urges the lower wedge 28 in a forward direction with respect to the upper wedge 26. This relative movement between the upper and lower wedges causes the wings 52 and 54 to slide along the ramp elements 56 thereby causing the wings 52 to be formed against and frictionally engage the upper surface of the channels 50, and the wings 54 are similarly forced against frictionally engage the lower surface of the channels 50. The follower 60 is operatively connected to the lower wedge 28 by being received in a bore 62 in the front end of the lower wedge and having a stem 64 disposed within a helical spring 66 (FIG. 7). One end of the spring 66 bears against the follower 60, and the other end of the spring bears against a plate 68 secured to the lower wedge by a pair of screws 70.

In the preferred embodiment of the invention, the ramp element 56 increases in vertical thickness from the rear end of the vise toward the fixed jaw 16 forming an angle of up to about three degrees. The preferred angularity of the ramp element 56 is ½ degree. The upper surface of the channel 50 is parallel with the base of the body 14 and the machine table, and the lower surface of the channel 50 is inclined downwardly from the rear of the vise toward the fixed jaw 16 at the same degree of angularity as the ramp element 56. In this way, the normal force exerted upon the wings 54 of the lower wedge 28 by the lower surface of the channels 50 has a slight longitudinal component in the forward direction which serves to resist any tendency of the wedges 26 and 28 to slip backwardly while being moved into locking relation with the body 14 as described above.

To release the locking engagement between the upper and lower wedges 26 and 28 and the body 14, the cam 24 is rotated through an arc of less than about 180° to the position shown in exemplary FIG. 6. As the cam 24 is rotated, the lug 48 moves out of engagement with the follower 60 and contacts the rear wall of the lug receiving aperture 42 thereby moving the lower wedge 28 longitudinally away from the upper wedge 26, releasing the upward pressure on the upper wedge and the downward pressure on the lower wedge, and eliminating the frictional engagement between the wedges 26 and 28 and the body 14.

When the cam 24 is in the position where the lug 48 is rotated toward the rear of the lug receiving aperture 42, the entire assembly consisting of the upper and lower wedges 26 and 28, the cam 24 and the movable jaw 20 can be quickly and easily moved longitudinally toward and away from the fixed jaw 16 by hand to any desired location along the body 14. Conversely, when the cam is rotated to the position where the lug 48 bears against the follower 60, the upper and lower wedges 26 and 28 and the cam 24 are locked in a fixed longitudinal position with respect to the body 14, and the movable jaw is afforded only a slight degree of freedom of movement toward and away from the fixed jaw 16 as will be described in more detail hereafter.

For tightly gripping the workpiece 18, the movable jaw 20 is arranged to be movable through a short distance toward and away from the fixed jaw 16 even when the cam 24 and upper and lower wedges 26 and 28 are locked in a fixed longitudinal position with respect to the body 14. To permit the above movement, the aperture 38 in the movable jaw 20 has an enlarged portion 72 adjacent the bottom of the movable jaw which is larger in the longitudinal direction than an upstanding boss 74 on the top of the upper wedge 26 which is received in the enlarged portion 72.

For biasing the movable jaw 20 into constant contact with the cam 24, a spring 76 is disposed in a bore 78 in the movable jaw 20 and bears at one end against the rear wall of the boss 74 and at the other end against a set screw 80 which is threadably received in the bore 78. The set screw 80 can be adjustably threaded into the bore 78 a sufficient distance to load the spring 76 with a compressive force capable of overcoming the sliding friction between the movable jaw 20 and the walls 32 and 34.

The spring 76 urges the movable jaw 20 rearwardly with respect to the upper wedge 26, and causes a follower pad 82 in the aperture 38 to bear against a cam surface 84 on the eccentric head 44 of the cam 24. In order to hold the movable jaw down upon the surface 36 as well as urging the movable jaw toward the fixed jaw 16, the cam surface 84 is conical in shape and faces downwardly at an acute angle with respect to the surface 36, and the follower pad 82 is disposed in a similar conical portion of the aperture 38 which is inclined at the same angle for cooperating with the cam surface 84.

For the purpose of easily gripping workpieces of various irregular shapes and at various angular positions with respect to the body of the vise, a set of bearing elements 86 is provided which may be interchangeably mounted on the front of the movable jaw 20. A semi-cylindrical recess 88 is formed in the front of the movable jaw 20 for receiving a bearing element 86, and a pair of mounting lugs 90 are rigidly attached to the movable jaw 20 in the recess 88. Each of the retaining lugs 90 is flared outwardly forming a frustoconical retaining surface at its outer end.

Figure 8:
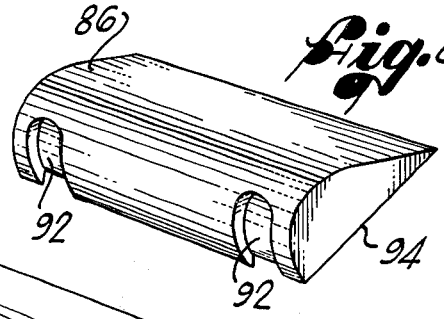
FIG. 8 is a perspective view of an interchangeable bearing member for use with the machine vise of the present invention.
Figure 9:
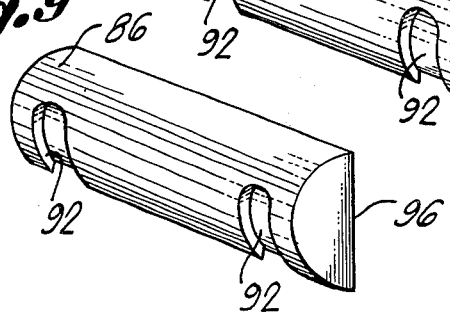
FIG. 9 is a perspective view of an alternative interchangeable bearing member for use with the machine vise of the present invention.

As can best be seen in FIGS. 8 and 9, various configurations of bearing elements 86 can be employed. Each of the bearing elements 86 is partially formed with a cylindrical surface for cooperating with the recess 88, and a pair of undercut grooves 92 which cooperate in a dovetail fashion with the flared mounting lug 90 for interchangeably securing the bearing elements 86 to the movable jaw 20. Any desired configuration of bearing element 86 may be employed as, for example, a bearing element having a downwardly facing surface 94 at any desired angle as illustrated in exemplary FIG. 8, or a flat vertical surface 96 as illustrated in exemplary FIG. 9.

Figure 10:
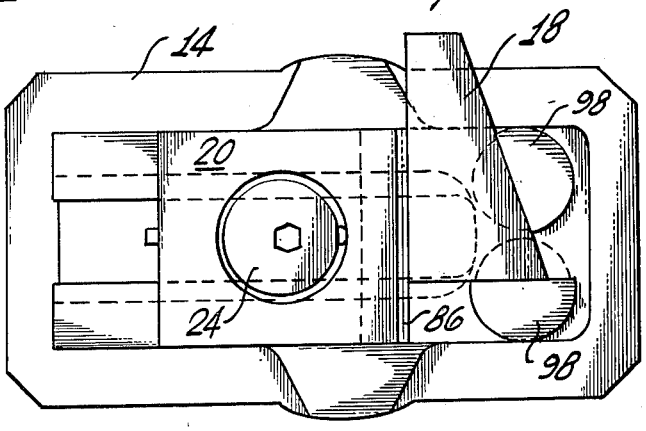
FIG. 10 is a top view of the machine vise of the present invention and illustrated holding an irregularly shaped workpiece.

In the preferred embodiment of the invention, the fixed jaw 16 is comprised of a pair of laterally positioned upright posts 98 each of which is mounted in a bore 100 in the front wall 30 (FIG. 2). Each of the posts 98 is rotatable within the bore 100 and is retained in the bore by a screw 102 which is inserted through a retaining cap 104 and threadably received in the bottom of the post 98. The portion of the posts 98 which extends above the body 14 is semi-cylindrical in shape, and as can best be seen in FIG. 10, the posts 98 may be oriented in any desired position for accommodating workpieces of various irregular shapes. When operating the machine vise of the present invention, a bearing element 86 is first selected which is suitable for bearing against the workpiece 18 which is to be held within the vise 10. The selected bearing element is then rotated into the semi-cylindrical recess 88 so that the grooves 92 fit over the flared mounting lugs 90 thereby holding the bearing element securely in place. The workpiece to be gripped by the vise is then placed on the surface 36 adjacent the fixed jaw 16, and with the cam 24 rotated to the position illustrated in exemplary FIG. 6, the movable jaw 20, cam 24, and upper and lower wedges 26 and 28 can be moved quickly and easily along the body 14 to a position adjacent the workpiece 18. For the purpose of firmly gripping the workpiece 18 within the vise 10, the handle 22 is employed for rotating the cam 24 through an arc or less than about 180°. As this is done, the lug 48 contacts the follower 60 and urges the lower wedge 28 toward the upper wedge 26 thereby locking the cam 24, and wedges 26 and 28 in a fixed longitudinal position with respect to the body 14 as described above. At the same time that the lug 48 is bearing against the follower 60, the cam surface 84 is bearing against the follower pad 82 and urging the movable jaw 20 toward the fixed jaw 16. The follower 60 is adjusted by means of the screws 70 so that during the last few degrees of the above mentioned arc, the wedges 26 and 28 and the cam 24 are locked in a fixed longitudinal position with respect to the body 14, and further rotation of the cam 24 only serves to compress the spring 66. However, during these last few degrees of rotation of the cam 24, the cam surface 84 continues to bear against the follower pad 82, and the movable jaw 20 is thereby urged through a small increment of distance toward the fixed jaw 16 to firmly grip the workpiece 18 within the vise 10.

If it is desired to remove the workpiece 18 and grip another workpiece of the same size, the cam 24 is rotated in a reverse direction through an arc of only about 45°. During this rotation, the cam surface 84 moves away from the follower pad 82, and the movable jaw 20 is urged away from the workpiece 18 by the force of the spring 76 as described above. By not rotating the cam 24 back through the entire arc of less than about 180°, the lug 48 does not contact the rear wall of the aperture 42 and therefore does not move the wedge 28 away from the wedge 26. Therefore, the cam 24 and wedges 26 and 28 remain in a fixed longitudinal position with respect to the body 14. A substitute workpiece 18 may then be placed adjacent the fixed jaw 16 or angle block 17, and the cam 24 can then be rotated to the gripping position as described above.

If it is desired to remove the workpiece 18 and secure another workpiece of a substantially different size in the vise, the cam 24 is rotated in a reverse direction out of its gripping position through an arch of less than about 180°. This causes the lug 48 to contact the rear wall of the aperture 42 and move the wedge 28 longitudinally away from the wedge 26 thereby releasing the wedges 26 and 28, the cam 24 and the movable jaw 20, so that they may be moved by hand quickly and easily to any desired position along the body 14.

From the foregoing, it will be appreciated that the vise 10 of the present invention provides a means by which the movable jaw 20 can be rapidly adjusted for holding workpieces of various sizes, and by which both the movable jaw 20 and the fixed jaw 16 can be easily adapted for holding irregularly shaped workpieces. Further, the vise of the present invention is trouble free and reliable in use, and is advantageously arranged to save valuable machine operating time.

While a particular form of the invention has been illustrated and described, it will also be apparent that various modifications can be made without departing from the spirit and scope of the invention.

I claim:

1. A machine vise comprising:

a body;

a fixed jaw mounted on top and at one end of said body;

a movable jaw mounted on said body and slidable toward and away from said fixed jaw, and having a vertically disposed central aperture therethrough;

a cam means disposed in said aperture and extending below said movable jaw;

an upper wedge and a lower wedge below said movable jaw arranged for locking cooperation within a longitudinal channel formed in said body, each of said upper wedge and said lower wedge having a vertically disposed central aperture therein;

said cam means being threadably received in said central aperture of said upper wedge, and having an eccentric lug extending into said central aperture of said lower wedge for moving said lower wedge into and out of locking relation with said upper wedge within said channel upon rotation of said cam means; and said cam means having a cam surface which bears against a following surface in said central aperture of said movable jaw for urging said movable jaw toward said fixed jaw upon rotation of said cam means.

2. A machine vise as defined in claim 1 wherein said body comprises, at one end, a generally lateral upstanding wall upon which said fixed jaw is mounted, and two longitudinal, laterally spaced, parallel upstanding walls forming a top surface upon which said movable jaw is slidably mounted;

said upper wedge and said lower wedge being disposed between said longitudinal walls and having laterally extending wedge-shaped wings projecting into a channel formed in the inward facing side of each of said longitudinal walls.

3. A machine vise as defined in claim 2 including a longitudinal ramp means in each of said channels and disposed between the wings of said upper wedge and said lower wedge.

4. A machine vise as defined in claim 2 wherein said channels have an upper surface and a lower surface, and said wings are arranged such that when said upper wedge and said lower wedge are moved longitudinally toward each other, said wings of said upper wedge and said wings of said lower wedge are urged into locking frictional engagement with said upper surface and said lower surface respectively; and when said upper wedge and said lower wedge are moved longitudinally away from said other, said wings of said upper wedge and said wings of said lower wedge are moved out of said locking frictional engagement.

5. A machine vise as defined in claim 4 wherein said lower surfaces of said channels are inclined downwardly toward said fixed jaw end of said body at an angle, and said ramp means have an upper and a lower surface which diverge at the same angle, thereby forming a thick end and a thin end, said thick end disposed in the end of said channel adjacent said fixed jaw.

6. A machine vise as defined in claim 5 wherein said angle is between about zero and three degrees.

7. A machine vise as defined in claim 5 wherein said angle is about ½ degree.

8. A machine vise as defined in claim 1 wherein, by rotating said cam means through an arc of less than 180 degrees, said lug moves said lower wedge and said upper wedge from a position out of locking relation into locking relation with each other, thereby securing said upper wedge and said lower wedge in a fixed position with respect to said body, and said cam surface moves said movable jaw toward said fixed jaw.

9. A vise comprising:

a body, a fixed jaw on said body, a movable jaw mounted on said body for movement toward and away said fixed jaw, cam means for urging said movable jaw into gripping relation with a workpiece disposed between said jaws, and means for selectively locking said cam means in a fixed position with respect to said body, said locking means including an upper wedge and a lower wedge disposed within a channel formed in said body, said upper wedge threadably receiving said cam means, and an eccentric lug projecting from said cam means for moving said lower wedge into locking relation with said upper wedge within said channel upon rotation of said cam means.

10. A vise as defined in claim 9 wherein said cam means includes a cam surface which bears against a following surface on said movable jaw for urging said movable jaw into gripping relation with said workpiece upon rotation of said cam means.

11. A vise as defined in claim 9 wherein said movable jaw includes a set of bearing elements interchangeably disposed on said movable jaw facing said fixed jaw for bearing upon workpieces of various irregular shapes.

12. A vise as defined in claim 9 wherein said fixed jaw is comprised of a plurality of laterally disposed upright posts which are mounted in said body for rotation about a vertical axis and which selectively present a flat or curved face toward said movable jaw for bearing upon workpieces of various irregular shapes.

13. A machine vise comprising:

a body having a generally horizontal plate, a generally U-shaped wall upstanding from said plate and including a base portion at one end of said body and two laterally spaced, longitudinal portions having inside facing walls, each formed with a longitudinal channel opening into said slot;

a fixed jaw mounted on said base portion of said U-shaped wall and extending upwardly from the top thereof;

a movable jaw mounted on top of said longitudinal portion spanning said slot and slidable toward and away from said fixed jaw, and having a vertically disposed central aperture therethrough opening into said slot;

an upper wedge and a lower wedge disposed in said slot beneath said movable jaw, each having laterally extending wedge-shaped wings projecting into said channels and cooperatively arranged to frictionally engage upper and lower surfaces in said channels when said upper wedge and said lower wedge are moved longitudinally toward each other, said upper wedge and said lower wedge having vertically disposed central apertures therein, said apertures being generally aligned with said central aperture of said movable jaw; and a cam means disposed for rotary movement in said central aperture of said movable jaw, extending therebelow being threadably received in said central aperture of said upper wedge, and having an eccentric lug extending downwardly into said central aperture of said lower wedge, said lug contacting a first side of said lower wedge aperture for moving said upper wedge and said lower wedge longitudinally toward each other, thereby frictionally engaging said wings in said channels and locking said upper wedge and lower wedge in a fixed position with respect to said body, upon rotation of said cam means through an arc of less than 180°, said lug contacting a second opposite side of said lower wedge aperture for moving said upper wedge and said lower wedge longitudinally away from each other, thereby releasing said frictional engagement between said wings and said channels, and said cam having a cam surface which bears against a following surface in said central aperture of said movable jaw for urging said movable jaw toward said fixed jaw upon rotation of said cam means.

* * * * *